United States Patent [19]

Kruesi et al.

[11] 4,324,582

[45] Apr. 13, 1982

[54] PROCESS FOR THE RECOVERY OF COPPER FROM ITS ORES

[76] Inventors: Paul R. Kruesi, 13950 Crabapple Rd., Golden, Colo. 80401; Veryl H. Frahm, Jr., 380 S. 36th St., Boulder, Colo. 80303

[21] Appl. No.: 158,448

[22] Filed: Jun. 11, 1980

[51] Int. Cl.[3] ..... C22B 1/02; C22B 1/06; C22B 1/08

[52] U.S. Cl. ..... 75/1 R; 75/7; 75/21; 75/72; 75/113; 75/116; 423/23; 423/38; 423/47

[58] Field of Search ..... 75/1 R, 1 T, 5, 6, 7, 75/21, 72, 116, 113; 423/23, 38, 47; 44/1 SR

[56] References Cited

U.S. PATENT DOCUMENTS

| | | | |
|---|---|---|---|
| 3,261,959 | 7/1966 | Connell et al. | 75/1 R |
| 3,955,960 | 5/1976 | Gorling | 75/3 |
| 4,076,607 | 2/1978 | Zavitsanos et al. | 44/1 S R |
| 4,123,230 | 10/1978 | Kirkbridge | 44/1 SR |
| 4,148,614 | 4/1979 | Kirkbridge | 44/1 SR |
| 4,152,120 | 5/1979 | Zavitsanos | 44/1 SR |

OTHER PUBLICATIONS

Zavitsanos, P.D., et al.; *Coal Desulfurization Using Microwave Energy* Report No. EPA-600/7-78-089, U.S. E.P.A., pp. 1-68 (1978).

*Primary Examiner*—Michael L. Lewis
*Attorney, Agent, or Firm*—Sheridan, Ross & McIntosh

[57] ABSTRACT

A process for the recovery of copper from its ores by conventional procedures requiring heat in which the source of heat is microwave energy. The microwave energy is used to selectively heat the copper compounds, such as sulfidic and oxidic compounds, in the ore, as respects the gangue, to convert the compounds into other compounds, such as oxides and chlorides, from which copper is more readily recoverable.

14 Claims, No Drawings

PROCESS FOR THE RECOVERY OF COPPER FROM ITS ORES

DESCRIPTION

TECHNICAL FIELD

The process of the present invention relates to the use of microwave energy in the recovery of copper and other metals from their ores and concentrates.

BACKGROUND ART

Copper as major industrial metal is recovered from naturally occurring ore deposits. These deposits may contain copper in the form of sulfides such as chalcopyrite, bornite, chalcocite and covellite, or oxides such as cuprite or tenovite, the hydroxy carbonates such as malachite or azurite, or as the silicates such as chrysocolla. The grade of such deposits has decreased as the richer deposits have been mined over the years, and it is not unusual for deposits containing as little as 0.4 percent copper to be mined today. Accordingly, the mining and transporting of the massive amounts of rock necessary for the recovery of copper requires comparatively large amounts of energy for the amount of copper recovered.

The established method of recovering copper from such low grade deposits has involved mining the deposits and then grinding the ore to a fine size to permit floating the liberated copper minerals. In cases where the mineralization is primarily oxides or silicates that are not amenable to flotation, the ore is often leached with acids to recover the copper. However, such acid leaching is not effective in recovering highly insoluble copper sulfide which may also be present and is in general susceptible to only a very poor recovery of the copper. Indeed, recoveries of more than 50 percent of the copper present in the copper sulfide ore are unusual and, when attained, frequently involve the fine grinding of the ore with a large expenditure of energy.

In the processing of copper sulfide ores it is frequently necessary to grind more than 90 percent of the rock to a screen mesh size of minus 60 mesh in order to liberate the copper sulfide particles for flotation. In doing this a great amount of energy is expended driving huge ball mills. Additionally, the grinding of the rock to such a small size results in the production of a large quantity of copper sulfides which are very fine, often finer than ten microns, and thus not recoverable by flotation. Indeed, recoveries of copper from low grade ores using flotation techniques are seldom over 90 percent.

When the copper sulfides are isolated by flotation they must still be smelted or otherwise converted to copper. The processes used frequently involve large amounts of energy to initiate chemical reactions.

The entire sequence of events leading to the recovery of copper from its ores and its conversion into metal is characterized by the expenditure of vast amounts of energy and complexity of processing. It would obviously be very desirable to minimize the effort put into breaking up the gangues with which the ore exists and put that energy exclusively into the copper compounds which one wishes to recover or convert.

Microwaves are well known for their use in radar and in communication transmission. They have been extensively used as a source of energy for cooking food. Although microwaves have been studied for many years and put to practical uses, the effects which they may have on many materials are not known. The effects of microwaves on many ores and minerals are not known, nor can they be readily predicted. The effects of microwaves on metal values contained with ores does not appear to be related in any predictable way to the chemical or physical properties of such metal values. For example, it has been found that copper in its oxide, sulfide or silicate forms is very susceptible to heating by microwaves of 915 megahertz or 2450 megahertz, whereas zinc oxide or sulfide does not respond, or responds only slightly. Likewise, it has been found that the sulfides of molybdenum and rhenium absorb microwaves. It has also been found that nickel, cobalt and manganese oxides absorb microwaves, but the oxides of iron and chromium, which are transition metals, do not absorb microwaves.

By the use of microwaves as herein disclosed, one can selectively heat the copper (whether oxidic or sulfidic) without the necessity of heating the whole rock mass, because the gangue is substantially transparent to microwave radiation while the copper minerals are very effective in absorbing the microwaves.

U.S. Pat. No. 2,733,983 to Daubenspeck teaches the use of ferric chloride at high temperatures of 600° C. to 700° C. to chlorinate nickel and cobalt oxides. U.S. Pat. No. 4,144,056 to Kruesi discloses heating a metal oxide or silicate in the absence of air with ferric chloride and a volatility depressant salt selected from the group consisting of alkali metal chlorides and ammonium chlorides for a time of about 30 minutes to about 1 hour at temperatures of from about 200° C. to about 600° C. Conventional heat sources are used in both processes where heat is required.

U.S. Pat. Nos. 4,123,230 and 4,148,614, both to Kirkbride, disclose the desulfurization of coal by subjecting the coal or slurry of coal particles in a hydrogen atmosphere to microwave energy to form hydrogen sulfide which is removed from the coal with solvents. U.S. Pat. No. 4,152,120 to Zavitsanos, et al, removes pyritic and organic sulfur from coal by mixing alkali metals or alkaline earth compounds with the coal and using microwave energy to selectively heat these compounds and the sulfur to convert organic and pyritic sulfur to soluble alkali and alkaline earth compounds which are removed from the coal. The subject matter of this patent is also disclosed in an article entitled "Coal Desulfurization Using Microwave Energy," Zavitsanus et al, published in U.S. Department of Commerce PB 285-880, June, 1978. This patent and the article teach the use of microwave energy to selectively heat pyritic and organic sulfur contained in the organic host material coal in the presence of other elements or compounds to convert the sulfur into soluble compounds which can be readily removed from the coal. They do not teach the use of microwave energy to selectively heat metal compounds in their inorganic mineral-like host materials, alone or in the presence of other elements or compounds, to form soluble compounds of the metals which are readily recoverable from the host material. Particularly, they do not teach the unexpected finding that the process will work on certain ores or minerals containing metal values and not on other ores and minerals to recover their metal values.

In treating copper ores it is only the copper compounds which are appreciably heated; the gangue of the ore does not appreciably absorb microwave radiation. None of the prior art recognizes the characteristic of the sulfides, oxides, hydroxy carbonates and silicates of copper to absorb microwaves or the fact that the accompanying gangue is low absorbant, transparent to and/or reflective of the microwave energy.

DISCLOSURE OF INVENTION

Microwave energy is used in processes requiring heat to recover copper from its oxidic or sulfidic ore. The microwave energy is used in processes known to the art in place of conventional heat sources thereby causing very rapid chemical reactions with substantial energy savings. Because the microwaves heat and activate primarily the copper component of the ore and not the gangue, they are useful for treating grades of ore at lower copper contents than could ordinarly be economically treated.

In the treating of copper sulfide ores or concentrates, the ore or concentrate may be heated by microwaves in the presence of oxygen either as a pure gas or diluted as in air. The microwaves may be applied to heat the copper sulfides sufficiently in the presence of oxygen to convert them to sulfates (a "sulfation roast", well known in the art), or to heat the sulfides sufficiently to produce the oxide and sulfur dioxide. Heating to produce the sulfate is preferred as requiring less energy.

The copper, now as a water soluble sulfate or acid soluble oxide, can be leached and recovered. As an example, it might be recovered from the water leach by solvent extraction and then stripped with sulfuric acid, and electrowon. The use of organic solvents to extract copper and the electrowinning of the extracted copper is well known and practiced commercially. Heretofore, however, there was no practical means to convert the copper sulfides to soluble sulfates without expending an excessive amount of energy. It was necessary either to grind the ore to liberate the copper sulfides, float to a concentrate and then roast the ore, or use an excessive amount of heat to heat the whole ore, both desired mineral and gangue, to reaction temperature.

In the conventional grinding and flotation of copper sulfide ores, a portion of the ore reports to slimes which can be finer than 10 microns and very difficult or impossible to recover by flotation. These slimes can readily be separated by cyclones and other physical means, but the resulting sulfide concentrate is too low grade to be recovered conventionally. Because the microwaves used in this invention will selectively heat all the copper sulfides to a temperature where they will be converted by a flow of oxygen to sulfates or oxides which are water or acid soluble, the problem of fine grains of ore reporting to the slimes is eliminated and it becomes practical to recover the copper from such concentrates.

In accordance with the present invention, an alternative to the oxidation of copper sulfide concentrates is the chlorination of sulfide and oxide ores. Frequently, large copper sulfide ore bodies are overlain by mixed copper oxide-copper sulfide ores in which the copper is difficult to recover. Such ores, when heated with a chlorine ion donor such as ferric chloride or cupric chloride to a sufficient temperature in the absence of air, can be converted to copper chlorides which are water soluble and from which the copper can be recovered by techniques which are well known. Heretofore the expense of heating the whole rock mass was considered too great for an economic recovery of the copper. These types of ores and such oxidic ores as malachite, azurite and chrysocolla lend themselves to recovery by blending the ore with a source of chloride ion such as chlorine gas, ferrous chloride or ferric chloride, cuprous chloride or cupric chloride, and drying. The dried copper mineral and chloride ion source are then irradiated with microwaves in the absence of air, and if ferrous or cuprous chloride is used, in the presence of chlorine. The microwaves heat the copper minerals to reaction temperature, forming water soluble or brine solution chlorides.

The reactions may be illustrated as follows:

$$3CuO+2FeCl_3 \rightarrow 3CuCl_2+Fe_2O_3$$

$$3CuO+2FeCl_2+Cl_2 \rightarrow 3CuCl_2+Fe_2O_3$$

$$CuFeS_2+3FeCl_3 \rightarrow CuCl+4FeCL_2+2S^o$$

$$CuS+2FeCL_3 \rightarrow CuCl_2+2FeCl_2+S^o$$

$$CuFeS_2+3CuCl_2 \rightarrow 4CuCl+FeCl_2+2S^o$$

$$CuS+CuCl_2 \rightarrow 2CuCl+S^o$$

BEST MODE OF CARRYING OUT THE INVENTION

The process of the present invention is applicable to the treatment of sulfides or oxidic (including oxides, hydrocarbonates and silicates) minerals of copper.

It is preferred that the ore or concentrate of copper be crushed so that it is readily handled in the microwave reacting unit. It is not necessary that the ore or concentrate be finely ground. Generally, ore of ½ inch or finer is satisfactory.

It is preferred that the ore or concentrate be dried by conventional means prior to the microwave reaction. Water is an excellent absorber of microwaves and can readily be removed by microwave irradiation, but this is an expensive means of removing water and if there are substantial amounts present, it may be preferable to remove it by conventional means. However, where only a little water is present or where there is insufficient water present to jusitfy its separate removal, it can be removed in the course of the microwave irradiation.

In the sulfation roast converting copper sulfides to copper sulfates, it is preferred to irradiate with microwaves for a sufficient time to heat the sulfide minerals to temperatures of between 350° C. and 700° C. At higher temperatures there is a tendency for copper iron oxide ferrites to form which are soluble only with difficulty. Air or oxygen can be used as the source of oxygen. Generally, irradiation times of less than 15 minutes will be sufficient to raise the copper sulfide particles in the ore or concentrate to reaction temperatures, although the precise time of irradiation will depend upon the power of the microwave source and the precise nature of the gangue associated with the copper sulfide. The time must be sufficient to convert substantially all of the copper metal value to soluble compounds.

Following irradiation of the sulfide, the ore or concentrate may be leached with water or with acidified water to dissolve the copper oxides as well as the copper sulfate formed. The soluble copper may be recovered by solvent extraction and electrowinning.

In the chlorination reaction it is preferred to treat the ore or concentrate with a ferrous chloride solution containing sufficient ferrous chloride so that there will be at least a stoichiometric quantity of ferrous chloride which will convert to ferric chloride in the presence of chlorine gas and react with the copper minerals present.

The ore or concentrate can then be dried. It is not necessary to dry completely nor to remove the water of hydration associated with the ferrous chloride. Alternatively one may use cuprous chloride and chlorine gas, although ferrous chloride is preferred. Also, alternatively, one may use ferric chloride in place of the ferrous chloride and chlorine. If ferric chloride is used, it is preferred to blend the dry ferric chloride with the dry ore prior to irradiation. The ore and reagents are then reacted by being heated by the microwave radiation. It is preferred that temperatures of the copper mineral be at least 300° C. for all reactions except the sulfation roast. The mass of the gangue will of course not reach such temperatures. The time of irradiation will depend upon the power of the microwave source and the gangue minerals present, but in general will be shorter than 10 minutes.

The invention is further illustrated by the following examples.

EXAMPLE 1

The following materials were all irradiated with microwave radiation of 2450 megahertz. Samples weighing 25 grams were irradiated for 6 minutes at power levels of 300 watts. Water was used as a ballast to prevent excess heating of the microwave source because of the poor absorption of some of the material. The temperature was measured as quickly as possible after irradiation.

| Material | Temperature °C. after 6 minutes irradiation |
|---|---|
| Sand | 36 |
| Iron Oxide | 34 |
| Sphalerite | 34 |
| Zinc Oxide | 38 |
| Cupric Oxide | 195 |
| Chalcopyrite | 324 |
| Bornite | >600 |
| Chalcocite | 124 |
| Chrysocolla | 108 |
| Covellite | 244 |

It is seen from the above results that zinc sulfide and the oxides of zinc and iron are not appreciably heated, while the oxides, sulfides and silicates of copper are. It is also noted that sand, which is representative of the host material for the copper minerals, is not appreciably heated.

EXAMPLE 2

Twenty-five gram samples of the following materials were irradiated 6 minutes at 915 megahertz and a power level of 250 watts. Water was present as a ballast to prevent damage to the microwave source because of the poor absorption of some of the materials. As soon as possible after irradiation the temperature of the material was measured showing the relative absorption of the microwave energy.

| Material | Temperature °C. after 6 minutes irradiation |
|---|---|
| Sand | 29 |
| Iron Oxide | 28 |
| Sphalerite | 34 |
| Zinc Oxide | 29 |
| Lead Oxide | 32 |
| Cupric Oxide | 70 |
| Chalcopyrite | 58 |

-continued

| Material | Temperature °C. after 6 minutes irradiation |
|---|---|
| Bornite | 73 |
| Chalcocite | 42 |
| Chrysocolla | 46 |
| Covellite | 79 |

The results show that the oxides, sulfides and silicates of copper are significantly more absorbent to microwaves than sand, the oxides of iron, zinc and lead and the sulfide ore of zinc.

EXAMPLE 3

A mixed copper oxide-copper sulfide ore from the oxidized zone of the large porphyry copper ore body contained 1.6 percent copper. Fifty-three percent of the copper was present as copper oxides and 47 percent of the copper was present as copper sulfides. A 113.4 gram sample of this copper ore, crushed to minus ½ inch but not ground, was put in a container having a flow of oxygen and subjected to 600 watts of 2450 megahertz radiation for 15 minutes. Sulfur dioxide was noted in the off-gases. The residue was leached with sulfuric acid and water at pH 1.0. Sixty-one percent of the copper was found to be soluble.

EXAMPLE 4

A 120 gram sample of the ore of Example 3 was blended with 11 grams of concentrated sulfuric acid and 3 grams of iron as ferrous chloride. It was irradiated for 10 minutes with 600 watts of 2450 megahertz radiation under a chlorine atmosphere. After cooling, the reaction mass was leached with a brine solution. Eighty-six percent of the copper was soluble.

EXAMPLE 5

A 94 gram sample of the ore of Example 3 was ground to minus 30 mesh and then was blended with 11 grams of concentrated sulfuric acid and 3 grams of iron as ferrous chloride, and dried. It was irradiated for 10 minutes with 600 watts of 2450 megahertz radiation. When cool, it was leached for 30 minutes with a brine leach at pH 2.2. Ninety-six percent of the copper was soluble.

EXAMPLE 6

Fifty grams of a mixed copper oxide-copper sulfide ore in which 85 percent of the copper is oxidic and the copper content is 0.77 percent was blended with 5.4 grams of the sulfuric acid and 3 grams of iron as ferrous chloride. The blend was dried and ground to minus 20 mesh. Under a chlorine atmosphere it was reacted for 3 minutes with 600 watts 2450 megahertz radiation. It was then water leached for ½ hour at pH 1.9 and 90 percent of the copper was water soluble.

EXAMPLE 7

One-hundred grams of a phorphyry copper ore containing 0.6 percent copper principally as chalcopyrite was ground to minus 12 mesh. Under a flow of oxygen it was irradiated at 600 watts with 2450 megahertz radiation for 20 minutes. It was then leached for 30 minutes with acidified water to pH 1.0 at room temperature. Forty-two percent of the copper was water soluble.

EXAMPLE 8

One hundred grams of a phorphyry copper ore containing 0.6 percent copper, principally a chalcopyrite, was ground to minus 12 mesh. One gram of iron was blended as ferrous chloride. The blend was dried and under a chlorine atmosphere was irradiated for 6 minutes at 600 watts of 2450 megahertz radiation. The cooled solids were leached with a brine water solution for 30 minutes. Ninety-one percent of the copper was brine soluble.

EXAMPLE 9

Twenty-five grams of a chalcopyrite copper concentrate containing 20 percent copper was blended with 5 grams of iron as ferrous chloride and dried. A blend of inert gas and chlorine was used to chlorinate the chalcopyrite during the microwave irradiation. To prevent excessive temperatures, the irradiation was on for one minute and off for three minutes. The irradiation was on for nine minutes at 300 watts and finally two minutes at 600 watts over a time span of 40 minutes. The cooled reaction mass was leached with water with a little peroxide to oxide cuprous to cupric chloride. Ninety-six percent of the copper was dissolved.

From the above examples, it is seen that the process of the invention is effective for the recovery of copper from its ores, including ores too poor for the recovery of metals by conventional processes. It is noted that all the host materials in the examples are inorganic materials.

While the invention has been illustrated by its application to the recovery of copper from its ores, it is by no means limited to this application. It has been found that the invention is equally effective for the recovery of nickel, cobalt, and manganese from their oxides and silicates wherein the source of heat is microwave energy and it is used alone to produce the metal or in conjunction with a reducing agent, such as, hydrogen gas or a chlorinating agent, such as, ferric chloride which serves as a chlorine donner. The reduced metals are recovered by conventional processes and metal values are recovered from the formed soluble chlorides by conventional processes.

Likewise, it has been found that molybdenum and rhenium are effectively recovered from their sulfide ores by the process of the invention using microwave energy to selectively heat the sulfides in the host materials under oxidizing or chlorinating conditions to convert them to soluble oxides and chlorides from which the metal values are recovered by conventional processes.

In contrast, it has been found that the invention is not operable for many ores in their host materials. For example, it has been found, as illustrated herein, that sphalerite and the oxide ores of zinc and iron are not appreciably heated over their host materials so that the invention cannot be used to recover these metal values from these compounds in their host minerals. These examples are only illustrative of many combinations of host materials and ores upon which the invention is probably not operative. This illustrates that it is highly unpredictable which host material-ore combination with which the invention is operable.

The invention is operable on any host material-ore combination in which the ore or compound containing the metal value is selectively heated over the host material by the microwave energy.

The process of the invention can be used for the recovery of metals from mixtures of compounds of different metals in mineral gangues or host materials which are less absorbent to microwaves than the compounds.

The absorption of microwave energy by a given material is a complex function which varies with frequency, and therefore response will vary over a range of frequencies and with different materials. Lower frequencies are preferred. Microwaves of different frequencies may be used at the same time, or on the same batch. Energy should be applied for a sufficient time to convert substantially all of the metal compound in the ore to the required compound in the interest of efficiency.

We claim:

1. A process for the recovery of copper from its sulfide and oxidic ores which comprises subjecting the ores to microwave energy under conditions to convert the sulfidic and oxidic compounds in the ores to compounds from which copper is more readily recoverable.

2. The process of claim 1 in which said ores are selected from the group consisting of copper sulfide ores, cuprite, tenovite, hydroxy carbonates, and silicates.

3. The process of claim 1 in which the sulfide ores are heated in the presence of oxygen to convert the copper sulfides to copper oxides.

4. The process of claim 3 in which the sulfide ores are heated to a temperature of about 300° C.

5. The process of claim 1 in which the sulfide ores are roasted in the presence of oxygen to convert the sulfides to sulfates.

6. The process of claim 5 in which the sulfides are heated to about 350° C. to 700° C.

7. The process of claim 1 in which the ores are heated in the presence of chlorine to convert them to chlorides.

8. The process of claim 7 in which the ores are heated to a temperature of at least about 300° C.

9. The process of claim 7 in which the source of chlorine is a member of the group consisting of chlorine gas, ferrous chloride, ferric chloride, cuprous chloride and cupric chloride.

10. The process of claim 9 wherein ferrous chloride is added to the ore and the chlorination reaction is initiated by the addition of chlorine gas to promote the formation of ferric chloride.

11. The process of claim 9 in which the source of chlorine is ferric chloride.

12. The process of claim 2 in which the copper sulfide ores are selected from the group consisting of chalcopyrite, barite, chalcocite and covellite.

13. The process of claim 2 in which the hydroxy carbonates are selected from the groups consisting of malachite and azurite.

14. The process of claim 2 in which the silicate is chrysocolla.

* * * * *